US008534872B2

(12) United States Patent
Liu et al.

(10) Patent No.: US 8,534,872 B2
(45) Date of Patent: Sep. 17, 2013

(54) LED ILLUMINATION DEVICE

(75) Inventors: Tay-Jian Liu, Taipei Hsien (TW); Na Zhang, Shenzhen (CN); Jian-Bing Qian, Shenzhen (CN)

(73) Assignees: Fu Zhun Precision Industry (Shen Zhen) Co., Ltd., Shenzhen (CN); Foxconn Technology Co., Ltd., New Taipei (TW)

( * ) Notice: Subject to any disclaimer, the term of this patent is extended or adjusted under 35 U.S.C. 154(b) by 827 days.

(21) Appl. No.: 12/581,174

(22) Filed: Oct. 19, 2009

(65) Prior Publication Data

US 2011/0044042 A1 Feb. 24, 2011

(30) Foreign Application Priority Data

Aug. 20, 2009 (CN) ..... 2009 1 0305830

(51) Int. Cl.
*F21V 29/00* (2006.01)

(52) U.S. Cl.
USPC ..... 362/294; 362/249.02; 362/373; 362/800; 362/646; 362/647

(58) Field of Classification Search
USPC ..... 362/249.02, 294, 373, 362, 345, 362/218, 311.02, 646, 647, 649, 650, 800
See application file for complete search history.

(56) References Cited

U.S. PATENT DOCUMENTS 5,813,750 A * 9/1998 Chou ..... 362/659
7,347,589 B2 * 3/2008 Ge ..... 362/294
7,806,564 B2 * 10/2010 Liang ..... 362/294

FOREIGN PATENT DOCUMENTS

CN 201265832 Y 7/2009

* cited by examiner

*Primary Examiner* — Jason Moon Han
*Assistant Examiner* — Jessica M Apenteng
(74) *Attorney, Agent, or Firm* — Altis & Wispro Law Group, Inc.

(57) ABSTRACT

An LED illumination device includes a heat dissipation part, an optical part and an electric part. The optical part includes an LED module attached on the heat dissipation part and an envelope mounted on the heat dissipation part and covering the LED module. The electric part includes a casing and a lamp cap. The casing is cup-shaped. The lamp cap includes a sleeve electrode and a spring electrode attached at a bottom of the sleeve electrode. The sleeve electrode and the spring electrode electrically power the LED module. One end of the casing along an axis thereof is mounted on bottom ends of the heat dissipation part and the optical part. The sleeve electrode is disposed around the other end of the casing. The spring electrode is resiliently deformable along an axis of the sleeve electrode.

19 Claims, 3 Drawing Sheets

LED ILLUMINATION DEVICE

BACKGROUND

1. Technical Field

The disclosure generally relates to light emitting diode (LED) illumination devices, and particularly to an LED illumination device with an illumination direction thereof being adjustable.

2. Description of Related Art

LEDs (light emitting diodes) are preferred for use in LED illumination devices rather than CCFLs (cold cathode fluorescent lamps) due to a high brightness, a long lifespan, and less pollution of the LED.

Nowadays, screw-type LED illumination devices are widely used. The screw-type LED illumination device is provided with a screw-type lamp cap at one end thereof for electrically connecting the LED illumination device with an external power source. Generally, the screw-type LED illumination devices emit light outwardly around a whole outer circumferential surface thereof. In use, the screw-type lamp cap of the LED illumination device is screwed into a screw-type lamp holder which is electrically connected with the external power source, until the screw-type lamp cap is firmly fixed in and electrically connected with the screw-type lamp holder to ensure a good electrical connection between the screw-type lamp cap and the screw-type lamp holder.

However, some screw-type LED illumination devices are designed to emit light only through a portion of an outer circumferential surface of the LED illumination device. Therefore, the screw-type LED illumination device is often required to be turned from a first position to a second position so that the emitted light can illuminate on the desired objects at the second position. However, after the screw-type LED illumination device is turned from the first position to the second position, the screw-type lamp cap may be electrically disengaged from the screw-type lamp holder to cause an electrical connection between the screw-type LED illumination device and the screw-type lamp holder to be cut off.

Therefore, it is desirable to provide an LED illumination device with an illumination direction thereof being adjustable.

DETAILED DESCRIPTION

Figure 1:
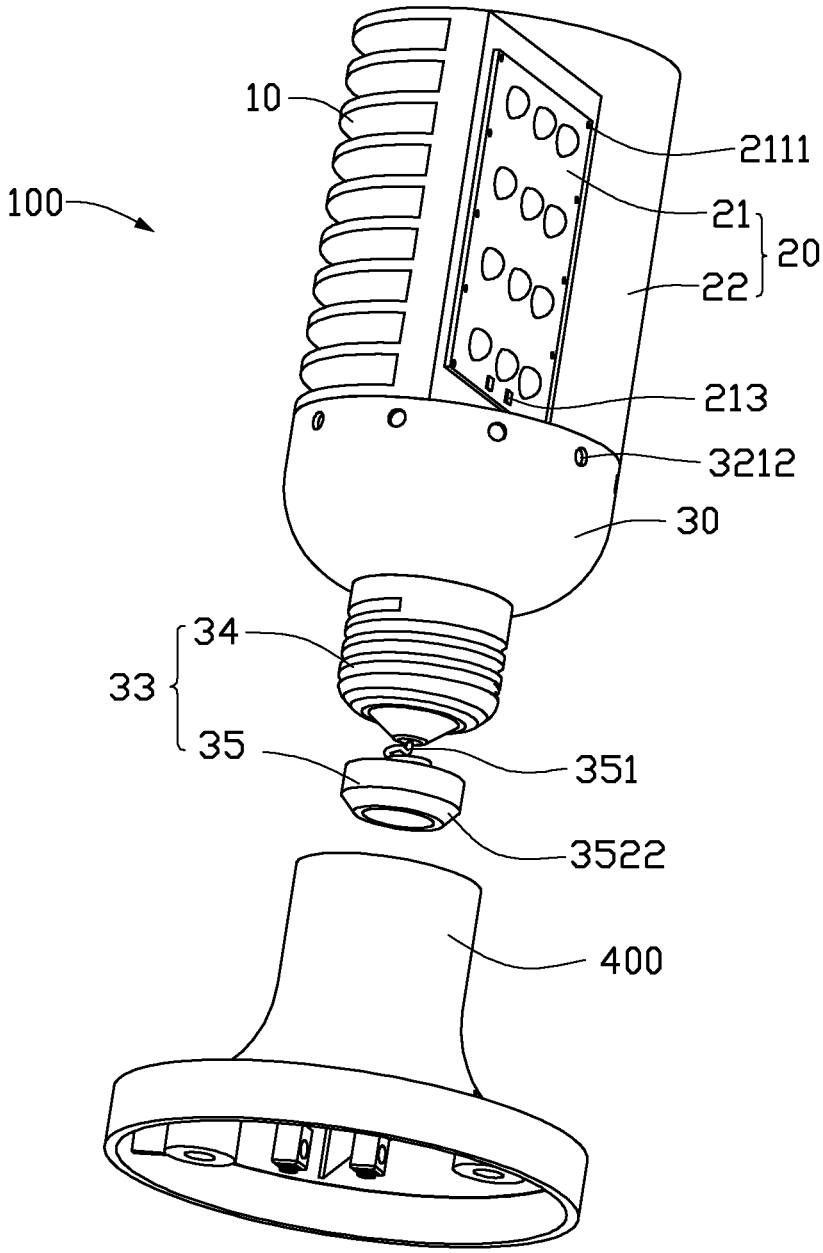
FIG. 1 is an isometric, assembled view of an LED illumination device in accordance with a first embodiment of the present disclosure.
Figure 2:
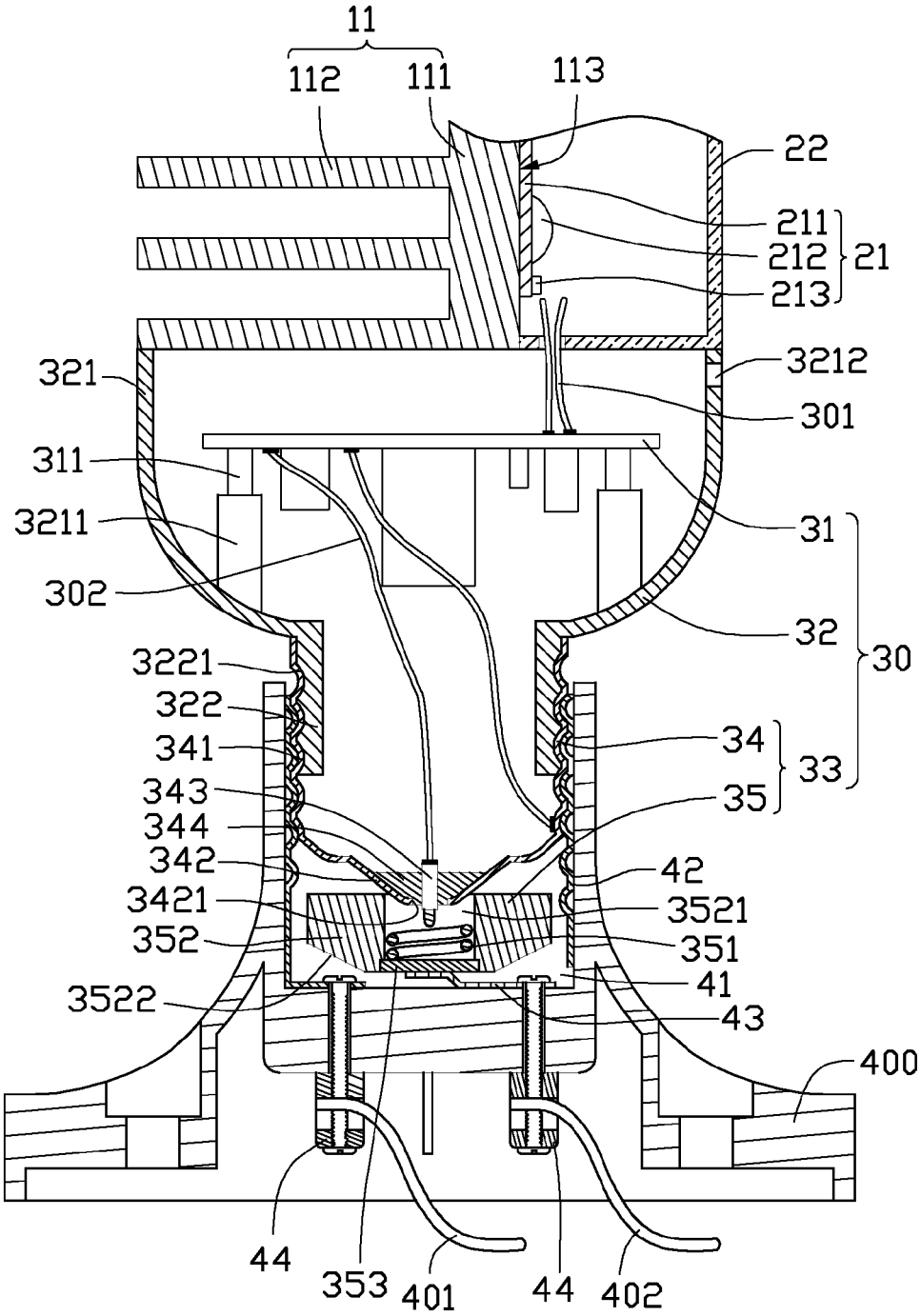
FIG. 2 is a cross sectional view of the LED illumination device of FIG. 1.

Referring to FIGS. 1 and 2, an LED illumination device 100 according to a first embodiment of the present disclosure includes a heat dissipation part 10, an optical part 20, and an electric part 30.

The heat dissipation part 10 includes a heat dissipation member 11. The heat dissipation member 11 is made of a thermal conductive material such as aluminum. The heat dissipation member 11 includes a vertical base plate 111 and a plurality of fins 112 extending horizontally outwardly from a left side of the base plate 111. The base plate 111 is rectangular. The fins 112 are semicircular and spaced from each other along a lengthwise direction of the base plate 111. A diameter of the fin 112 is equal to a width of the base plate 111. A right side of the base plate 111 forms a heat absorbing surface 113.

The optical part 20 is arranged at a right side of the heat dissipation part 10. The optical part 20 includes an LED module 21 and an envelope 22 covering the LED module 21. The LED module 21 includes a substrate 211, a plurality of LEDs 212 arranged on the substrate 211, and a plurality of electrodes 213 formed on the substrate 211. The LEDs 212 are evenly spaced from each other and electrically attached on the substrate 211 with emitting surfaces thereof facing the envelope 22. The substrate 211 of the LED module 21 is rectangular and attached on the heat absorbing surface 113 of the heat dissipation member 11, whereby heat generated by the LEDs 212 is conducted to the heat dissipation member 11 via the substrate 211 for dissipation. A layer of thermal interface material (TIM) may be applied between the substrate 211 of the LED module 21 and the heat absorbing surface 113 of the heat dissipation member 11 to eliminate an air interstice therebetween, to thereby enhance a heat conduction efficiency between the LED module 21 and the heat dissipation member 11. The substrate 211 defines a plurality of mounting holes 2111 near front and rear edges thereof. Fasters such as screws are adopted to extend through the mounting holes 2111 and screw into the base plate 111 to mount the substrate 211 of the LED module 21 onto the heat absorbing surface 113 of the heat dissipation member 11. Alternatively, the substrate 211 of the LED module 21 can be attached to the heat absorbing surface 113 of the heat dissipation member 11 fixedly and intimately through surface mount technology (SMT), whereby an interface between the substrate 211 and the base plate 111 can be eliminated and a thermal resistance between the LED module 21 and the heat dissipation member 11 is reduced.

The envelope 22 is transparent and has a semicircular cross section. A diameter of the cross section of the envelope 22 is equal to that of the fin 112. The envelope 22 is arranged at the right side of the base plate 111 of the heat dissipation member 11 and mounted on the base plate 111, with the LED module 21 covered by the envelope 22. The envelope 22 and the fins 112 of the heat dissipation member 11 cooperatively define an elongated, cylindrical profile of the LED illumination device 100. The envelope 22 functions as an optical lens for the LED module 21 to guide light emitted by the LEDs 212 of the LED module 21 to an ambient environment and as a shell to protect the LED module 21 from dust and external damage.

The electric part 30 is arranged at a bottom end of the LED illumination device 100. The electric part 30 is connected with the heat dissipation part 10 and the optical part 20. The electric part 30 includes a circuit board 31, a casing 32 and a lamp cap 33. The circuit board 31 is received in the casing 32. The circuit board 31 has a pair of first wires 301 extending upwardly and a pair of second wires 302 extending downwardly therefrom. The first wires 301 are connected with the electrodes 213 of the LED module 21, and the second wires 302 are connected with the lamp cap 33 which is used to connect with an external power source to provide the LED module 21 a necessary power to emit light.

The casing 32 is cup-shaped. The casing 32 includes a large section 321 and a small section 322 at two opposite ends thereof. The large section 321 is mounted to bottom ends of the heat dissipation part 10 and the optical part 20, and the small section 322 is located away from the heat dissipation part 10 and the optical part 20. The large section 321 connects with the heat dissipation member 11 of the heat dissipation part 10 and the envelope 22 of the optical part 20. The circuit board 31 is received in the large section 321. The large section 321 extends a plurality of mounting seats 3211 upwardly from an inner surface thereof. A plurality of mounting poles 311 extends downwardly from the circuit board 31 corresponding to the mounting seats 3211. Each of the mounting poles 311 faces a corresponding mounting seat 3211 of the large section 321 for mounting the circuit board 31 in the large section 321. The large section 321 defines a plurality of pores 3212 through a circumferential surface at a top end thereof. The pore 3212 communicates an inner space of the casing 32 with the ambient environment outside the casing 32, whereby heat generated by the circuit board 31 can be dissipated to the ambient environment through the pores 3212. The small section 322 of the casing 32 defines a plurality of threads 3221 in an outer surface thereof to screw with the lamp cap 33.

The lamp cap 33 includes a sleeve electrode 34 and a spring electrode 35. The sleeve electrode 34 is made of an electrically conductive metal sheet. The sleeve electrode 34 includes a tubular-shaped main body 341 and a cone-shaped bottom plate 342 extending downwardly from a bottom end of the main body 341. The main body 341 defines a plurality of threads in inner and outer surfaces thereof. The threads of the inner and the outer surfaces of the main body 341 are complementary. The threads of the inner surface of the main body 341 match with the threads 3221 of the small section 322 of the casing 32. The bottom plate 342 defines a through hole 3421 in a central portion thereof for receiving an electric pole 343. A diameter of the electric pole 343 is smaller than that of the through hole 3421 of the bottom plate 342. An insulating member 344 is attached on an inner surface of the bottom plate 342. The electric pole 343 extends through the insulating member 344 and is electrically insulated from the bottom plate 342 via the insulating member 344. The pair of second wires 302 are respectively connected with the inner surface of the main body 341 and the electric pole 343.

The spring electrode 35 is located outside the sleeve electrode 34 and attached to an outer surface of the bottom plate 342 of the sleeve electrode 34. The spring electrode 35 includes a spring 351, an insulating seat 352, and an electrical conductive plate 353. An outer diameter of the insulating seat 352 is smaller than that of the main body 341 of the sleeve electrode 34. The insulating seat 352 defines an aperture 3521 through a central portion thereof. The electrical conductive plate 353 is mounted at a bottom end of the insulating seat 352 and faces the aperture 3521. The spring 351 is received in the aperture 3521 of the insulating seat 352 with two opposite ends thereof respectively connected with the electric pole 343 and the electrical conductive plate 353. A diameter of the spring 351 is smaller than that of the aperture 3521 of the insulating seat 352. Before the spring 351 is compressed, a lower portion of the spring 351 is received in the aperture 3521 of the insulating seat 352, and an upper portion of the spring 351 protrudes out of the insulating seat 352, whereby the bottom plate 342 of the sleeve electrode 34 is spaced from the insulating seat 352, as shown in FIG. 1. A top end of the insulating seat 352 faces the bottom plate 342 of the sleeve electrode 34. A bottom end of the insulating seat 352 is tapered downwardly, and a tapered outer surface 3522 is formed at the bottom end of the insulating seat 352. Thus, when the lamp cap 33 is screwed into the lamp holder 400, the insulating seat 352 can be easily inserted into the lamp holder 400 due to the presence of the tapered outer surface 3522 of the insulating seat 352. The electric pole 343, the spring 351 and the electrical conductive plate 353 each are made of an electrically conductive material having a low electrical resistance.

The lamp holder 400 is a conventional one and defines a cavity 41 therein for receiving the lamp cap 33 of the LED illumination device 100. The cavity 41 is substantially cylindrical. The lamp holder 400 includes a screw cap 42 attached on an inner surface of the cavity 41 and a resilient flake 43 mounted at a central portion of a bottom end of the cavity 41. The screw cap 42 and the resilient flake 43 are respectively connected with a naught wire 401 and a live wire 402 of the external power source via two connectors 44.

Referring to FIG. 2, in assembling the LED illumination device 100 onto the lamp holder 400, the lamp cap 33 of the LED illumination device 100 is screwed into the cavity 41 of the lamp holder 400. As the lamp cap 33 is screwed into the lamp holder 400, the spring 351 of the spring electrode 35 is gradually depressed by the sleeve electrode 34 towards the resilient flake 43, whereby the electrical conductive plate 353 of the spring electrode 35 is pushed to resiliently and intimately contact with the resilient flake 43 of the lamp holder 400. Since the spring 351 can be freely compressed, the lamp cap 33 can be turned within 360 degrees to adjust the illumination direction of the LED illumination device without a worry that the electrical conductive plate 353 of the lamp cap 33 will be electrically disengaged from the resilient flake 43 of the lamp holder 400. In use, the optical part 20 of the LED illumination device 100 can be easily adjusted to the proper position so that the emitted light of the LED illumination device 100 can illuminate on desired objects while the lamp cap 33 of the LED illumination device 100 is still maintained in a good electrical connection with the lamp holder 400.

Figure 3:
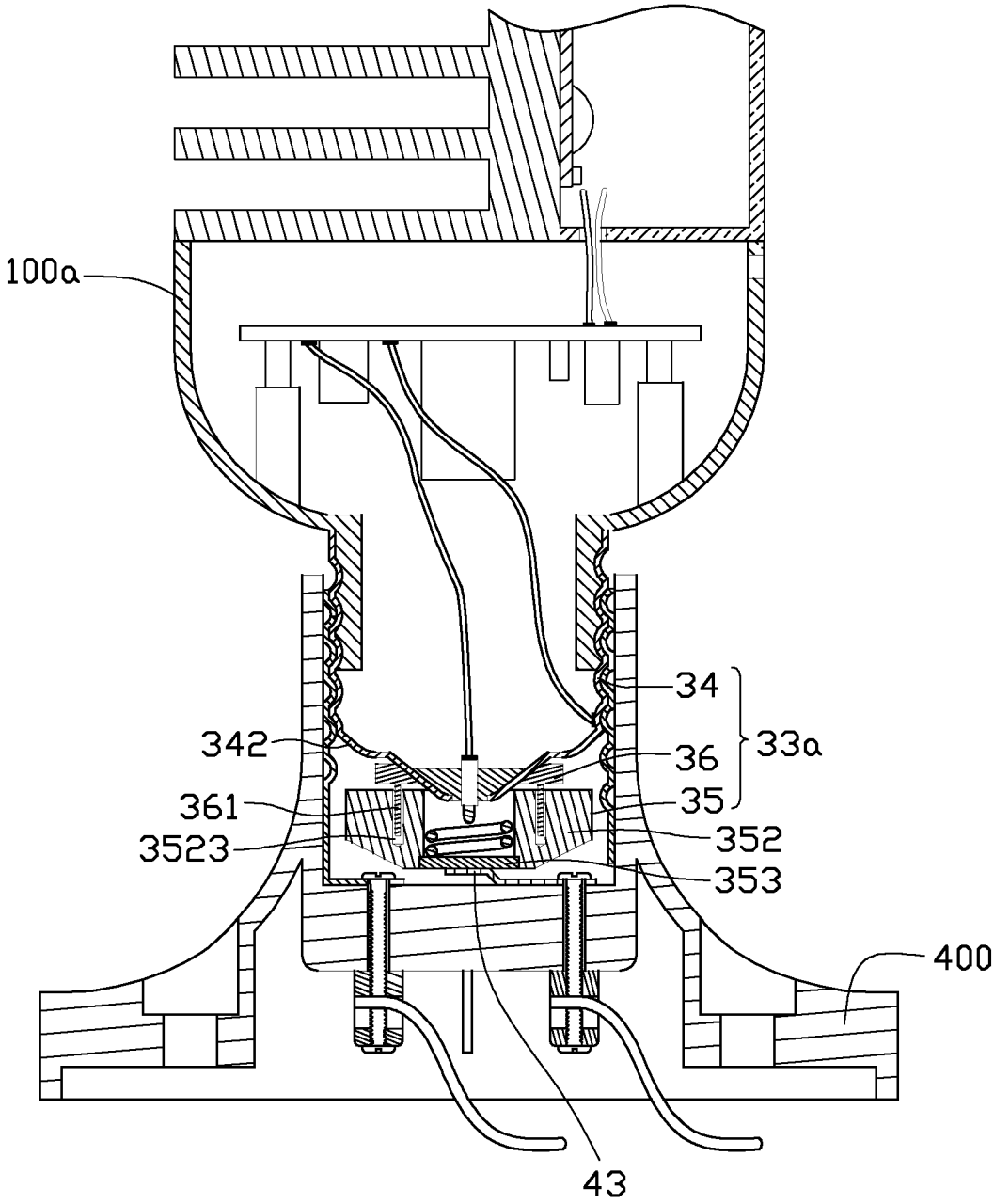
FIG. 3 is a cross sectional view of an LED illumination device in accordance with an alternative embodiment of the present disclosure.

Referring to FIG. 3, an LED illumination device **100*a* according to an alternative embodiment is illustrated. Except the following differences, the LED illumination device 100*a* of the present embodiment is essentially the same as the LED illumination device 100 shown in FIGS. 1 and 2. In the present embodiment, the lamp cap 33*a* further includes a tray 36 attached to an outer surface of the bottom plate 342 of the sleeve electrode 34. The tray 36 protrudes a plurality of positioning pins 361 downwardly therefrom, and the insulating seat 352 of the spring electrode 35 defines a plurality of blind holes 3523 corresponding to the positioning pins 361. When the lamp cap 33*a* of the LED illumination device 100*a* is screwed into the lamp holder 400, each of the positioning pins 361 slides into a corresponding blind hole 3523 to ensure the spring electrode 35 to move along an axial direction of the cavity 41 of lamp holder 400. In addition, the positioning pins 361 and the blind holes 3523 enable a stable electrical connection between the electrical conductive plate 353 of the spring electrode 35 and the resilient flake 43 of the lamp holder 400 when the LED illumination device 100*a*** is turned to adjust the illumination direction thereof.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED illumination device, comprising:

a heat dissipation part comprising a heat dissipation member, the heat dissipation member comprising a base plate and a plurality of fins extending outwardly from the base plate, the base plate comprising a first side and a second side opposite to the first side, the plurality of fins being formed on the first side of the base plate;

an optical part comprising an LED module and an envelope, the LED module being thermally attached to the second side of the base plate, the envelope being mounted on the second side of the base plate and covering the LED module, the plurality of fins and the LED module facing two opposite lateral directions of the LED illumination device respectively;

an electric part arranged at bottom ends of the heat dissipation part and the optical part, the electric part comprising a casing, a circuit board and a lamp cap, the casing being cup-shaped and receiving the circuit board therein, one end of the casing being mounted on the bottom ends of the heat dissipation part and the optical part directly, the other end of the casing being opposite to the one end and distant from the bottom ends of the heat dissipation part and the optical part;

the lamp cap comprising a sleeve electrode and a spring electrode, the sleeve electrode being disposed around the other end of the casing, the spring electrode being attached to a bottom of the sleeve electrode and insulated from the sleeve electrode, the sleeve electrode and the spring electrode being electrically connected with the LED module through the circuit board;

wherein the sleeve electrode comprises a tubular main body disposed around the another end of the casing and a bottom plate formed at a bottom end of the main body, the bottom plate defines a through hole therein, an electric pole is positioned in the through hole and insulated from the bottom plate, the spring electrode comprises a spring and an electrical conductive plate, two opposite ends of the spring are electrically connected with the electric pole and the electrical conductive plate, respectively, and the sleeve electrode and the electric pole electrically power the LED module.

2. The LED illumination device of claim 1, wherein the spring electrode further comprises an insulating seat, the insulating seat defines an aperture along an axial direction thereof, the electrical conductive plate is mounted at a bottom end of the aperture, the spring is received in the aperture and connects the electric pole with the electrical conductive plate.

3. The LED illumination device of claim 2, wherein a bottom end of the insulating seat is tapered downwardly, and a tapered outer surface is formed at the bottom end of the insulating seat.

4. The LED illumination device of claim 2, wherein the lamp cap further comprises a tray attached to an outer surface of the bottom plate of the sleeve electrode, the tray protrudes a plurality of positioning pins towards the insulating seat, and the insulating seat defines a plurality of blind holes corresponding to the positioning pins, each of the positioning pins is slideable in a corresponding blind hole of the insulating seat.

5. The LED illumination device of claim 1, further comprising a lamp holder, the lamp holder defines a cavity therein for receiving the lamp cap of the LED illumination device, the lamp holder comprises a screw cap attached on an inner surface of the cavity and a resilient flake mounted at a bottom of the cavity, when the lamp cap of the LED illumination device is screwed into the lamp holder, the main body of the sleeve electrode electrically connects with the screw cap of the lamp holder, and the spring of the spring electrode is compressed to cause the electrical conductive plate of the spring electrode to engage with the resilient flake of the lamp holder.

6. The LED illumination device of claim 1, wherein an insulating member is attached to an inner surface of the bottom plate, the electric pole is mounted in the insulating member to be insulated from the bottom plate of the sleeve electrode.

7. The LED illumination device of claim 1, wherein the bottom plate of the sleeve electrode is cone-shaped and extends downwardly from the bottom end of the main body.

8. The LED illumination device of claim 1, wherein the circuit board extends a pair of first wires and a pair of second wires therefrom, the first wires are connected with the LED module, and the second wires are respectively connected with the main body of the sleeve electrode and the electric pole.

9. The LED illumination device of claim 8, wherein the casing comprises a large section and a small section at two opposite end thereof, the heat dissipation part and the optical part are mounted to the large section of the casing, the sleeve electrode is disposed around an outer surface of the small section of the casing, the circuit board is received in large section of the casing.

10. The LED illumination device of claim 9, wherein the large section extends a plurality of mounting seats upwardly from an inner surface thereof, the circuit board extends a plurality of mounting poles downwardly corresponding to the mounting seats, each of the mounting poles faces a corresponding mounting seat for mounting the circuit board in the large section.

11. The LED illumination device of claim 9, wherein the large section defines a plurality of pores through a circumferential surface thereof, the pore communicates an inner space of the casing with an ambient environment outside the casing.

12. The LED illumination device of claim 1, wherein the base plate is rectangular, the fins are semicircular and spaced from each other along the base plate, the envelope is transparent and has a semicircular cross section, the envelope and the fins of the heat dissipation member cooperatively define an elongated, cylindrical profile of the LED illumination device.

13. The LED illumination device of claim 12, wherein the LED module comprises a rectangular substrate attached to the base plate of the heat dissipation member and a plurality of LEDs arranged on the substrate.

14. An LED illumination device, comprising:

a heat dissipation part comprising a heat dissipation member;

an optical part comprising an LED module and an envelope, the LED module being thermally attached to the heat dissipation member, the envelope being mounted on the heat dissipation member and covering the LED module;

an electric part arranged at bottom ends of the heat dissipation part and the optical part, the electric part comprising a casing and a lamp cap, the casing being cup-shaped and, one end of the casing being mounted on the bottom ends of the heat dissipation part and the optical part, another end of the casing being opposite to the one end and distant from the bottom ends of the heat dissipation part and the optical part;

the lamp cap comprising a sleeve electrode and a spring electrode, the sleeve electrode being disposed around the another end of the casing, the spring electrode being attached to a bottom of the sleeve electrode and insulated from the sleeve electrode;

wherein the sleeve electrode comprises a tubular main body disposed around the another end of the casing and a bottom plate formed at a bottom end of the main body, the bottom plate defines a through hole therein, an electric pole is positioned in the through hole and insulated from the bottom plate, the spring electrode comprises a spring and an electrical conductive plate, two opposite ends of the spring are electrically connected with the electric pole and the electrical conductive plate, respectively, and the sleeve electrode and the electric pole electrically power the LED module.

15. The LED illumination device of claim 14, wherein the spring electrode further comprises an insulating seat, the insulating seat defines an aperture along an axial direction thereof, the electrical conductive plate is mounted at a bottom end of the aperture, the spring is received in the aperture and connects the electric pole with the electrical conductive plate.

16. The LED illumination device of claim 14, further comprising a lamp holder, the lamp holder defines a cavity therein for receiving the lamp cap of the LED illumination device, the lamp holder comprises a screw cap attached on an inner surface of the cavity and a resilient flake mounted at a bottom of the cavity, when the lamp cap of the LED illumination device is screwed into the lamp holder, the main body of the sleeve electrode electrically connects with the screw cap of the lamp holder, and the spring of the spring electrode is compressed to cause the electrical conductive plate of the spring electrode to engage with the resilient flake of the lamp holder.

17. The LED illumination device of claim 14, wherein an insulating member is attached to an inner surface of the bottom plate, the electric pole is mounted in the insulating member to be insulated from the bottom plate of the sleeve electrode.

18. The LED illumination device of claim 14, wherein the bottom plate of the sleeve electrode is cone-shaped and extends downwardly from the bottom end of the main body.

19. The LED illumination device of claim 14, wherein the electric part further comprises a circuit board, the circuit board is received in the casing, the circuit board extends a pair of first wires and a pair of second wires therefrom, the first wires are connected with the LED module, and the second wires are respectively connected with the main body of the sleeve electrode and the electric pole.

* * * * *